US010434627B2

(12) United States Patent
Attur

(10) Patent No.: US 10,434,627 B2
(45) Date of Patent: Oct. 8, 2019

(54) COMPONENTS FOR A CHEMICAL MECHANICAL POLISHING TOOL

(71) Applicant: Applied Materials, Inc., Santa Clara, CA (US)

(72) Inventor: Sreenidhi Attur, Bangalore (IN)

(73) Assignee: APPLIED MATERIALS, INC., Santa Clara, CA (US)

( * ) Notice: Subject to any disclaimer, the term of this patent is extended or adjusted under 35 U.S.C. 154(b) by 444 days.

(21) Appl. No.: 14/947,802

(22) Filed: Nov. 20, 2015

(65) Prior Publication Data

US 2016/0176016 A1 Jun. 23, 2016

Related U.S. Application Data

(60) Provisional application No. 62/094,484, filed on Dec. 19, 2014.

(51) Int. Cl.
*B24B 53/017* (2012.01)
*B24B 37/32* (2012.01)
(Continued)

(52) U.S. Cl.
CPC ..... *B24B 53/017* (2013.01); *B24B 37/32* (2013.01); *B24B 37/34* (2013.01); *B24B 57/02* (2013.01)

(58) Field of Classification Search
CPC ..... B24B 37/30; B24B 37/32; B24B 37/042; B24B 37/10; B24B 37/04; B24B 37/20; B24B 53/017
(Continued)

(56) References Cited

U.S. PATENT DOCUMENTS 5,990,012 A 11/1999 Robinson et al.
6,540,595 B1 4/2003 Birang
(Continued)

FOREIGN PATENT DOCUMENTS

CN 102015290 A 4/2011
CN 103862364 A 6/2014
(Continued)

OTHER PUBLICATIONS

Babcock, Dale, "Materials for Oleophobic and Hydrophobic Coatings" Satomer-Booth 748, Boston, MA (2012), 34 pgs.
(Continued)

*Primary Examiner* — Monica S Carter
*Assistant Examiner* — Lauren M Beronja
(74) *Attorney, Agent, or Firm* — Patterson + Sheridan LLP

(57) ABSTRACT

A component in a CMP tool disclosed herein having a surface and a hydrophobic layer deposited on the surface. In one example, the component is a component for delivering a fluid in a CMP tool. The component for delivering a fluid in a CMP tool includes an elongated member having a first end and a second end, and an elongated upper surface extending between the two ends. A hydrophobic layer is deposited on the elongated upper surface. In another example, the component is a ring shaped body having an upper side and a lower side. A hydrophobic layer is deposited on the inner surfaces of both the upper and lower sides. In another example, the component is a disk shaped body having a top surface, bottom surface, and ledge defined by the top and bottom surfaces. A hydrophobic layer is deposited on the surfaces and the ledge.

13 Claims, 7 Drawing Sheets

(51) Int. Cl.
*B24B 37/34* (2012.01)
*B24B 57/02* (2006.01)

(58) Field of Classification Search
USPC ..... 451/398, 388, 287–290
See application file for complete search history.

(56) References Cited

U.S. PATENT DOCUMENTS

| | | | | |
|---|---|---|---|---|
| 7,614,939 | B2 | 11/2009 | Tolles et al. | |
| 2003/0211743 | A1 | 11/2003 | Chang et al. | |
| 2003/0236056 | A1 | 12/2003 | Boo et al. | |
| 2005/0064709 | A1 | 3/2005 | Shimomura et al. | |
| 2007/0287301 | A1* | 12/2007 | Xu | C23C 16/308 438/780 |
| 2008/0113513 | A1 | 5/2008 | Baum | |
| 2008/0178917 | A1 | 7/2008 | Miyagi et al. | |
| 2010/0330886 | A1* | 12/2010 | Wu | B24B 53/017 451/56 |
| 2011/0018108 | A1* | 1/2011 | Kohmura | C09D 7/61 257/632 |
| 2011/0053479 | A1* | 3/2011 | Kim | B24D 7/06 451/548 |
| 2011/0312182 | A1* | 12/2011 | Borucki | B24B 37/042 438/693 |
| 2012/0264229 | A1 | 10/2012 | Wan | |
| 2012/0264299 | A1 | 10/2012 | Liao et al. | |
| 2014/0213158 | A1* | 7/2014 | Umemoto | B24B 37/105 451/73 |
| 2014/0235144 | A1 | 8/2014 | Kim et al. | |

FOREIGN PATENT DOCUMENTS

| | | | |
|---|---|---|---|
| EP | 1848028 | A1 | 10/2007 |
| JP | 2000-349054 | A | 12/2000 |
| JP | 2003133270 | A | 5/2003 |
| JP | 2003179021 | A | 6/2003 |
| JP | 2005082719 | A | 3/2005 |
| JP | 2006185901 | A | 7/2006 |
| JP | 2006223936 | A | 8/2006 |
| JP | 2008183532 | A | 8/2008 |
| JP | 4177214 | B2 | 11/2008 |
| JP | 2009539626 | A | 11/2009 |
| JP | 4892912 | B2 | 3/2012 |
| JP | 2012051037 | A | 3/2012 |
| JP | 2013206984 | A | 10/2013 |
| KR | 20070026020 | A | 3/2007 |
| KR | 20130038764 | A | 4/2013 |
| WO | 2007143566 | A2 | 12/2007 |

OTHER PUBLICATIONS

Boinovich, L B, et al. "Hydrophobic Materials and Coatings: Principles of Design, Properties and Applications", Russian Chemical Reviews 77, vol. 7, pp. 583-600 (2008).

Arkles, Barry, "Hydrophobicity, Hydrophilicity and Silanes", Reprinted with permission from the October (10 pgs.).

PCT international search report and written opinion of PCT/US2015/061643 dated Feb. 29, 2016.

Office Action from Japanese Patent Application No. 2017-532683 dated Jan. 28, 2019.

Chinese Office Action dated Oct. 31, 2018, for Chinese Patent Application No. 201580066895.1.

EPO Extended European Search Report dated Sep. 13, 2018, for European Application No. 15870598.8.

Taiwan Office Action dated Apr. 23, 2019 for Application No. 104138767.

* cited by examiner

COMPONENTS FOR A CHEMICAL MECHANICAL POLISHING TOOL

CROSS-REFERENCE TO RELATED APPLICATIONS

This application claims priority from U.S. Provisional Application Ser. No. 62/094,484, filed Dec. 19, 2014, which is hereby incorporated by reference in its entirety.

BACKGROUND

Field

Embodiments described herein generally relate to a component for use in a chemical mechanical polishing tool, wherein the component includes a hydrophobic layer disposed on a surface of the component.

Description of Related Art

The present disclosure relates generally to chemical mechanical polishing of substrates, and more particularly to components of a chemical mechanical polishing apparatus.

Integrated circuits are typically formed on substrates, such as silicon wafers, by sequential deposition of conductive, semiconductive, or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. Therefore, there is a need to periodically planarize the substrate surface to provide a flat surface.

Chemical mechanical polishing (CMP) is one accepted method of planarization. CMP typically includes the substrate mounted on a carrier or polishing head. The exposed surface of the substrate is then placed against a rotating polishing pad. The carrier head provides a controllable load, i.e., pressure, on the substrate to push the substrate against the polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate.

The polishing slurry may also contact and adhere to components of the CMP tool. Over time, the polishing slurry can rub over the surface of the components thereby dislodging component particles. Some of these particles may fall on to the polishing pad, which may result in scratching of the substrate. Scratches may result in substrate defects, which lead to performance degradation while polishing of the finished device. Additionally, the slurry particles may begin to erode the components of the CMP tool that are contacted by the slurry. Thus, the life spans of those parts are decreased, and the parts need to be replaced more readily.

Therefore, there is a need for improved components for use in CMP tools.

SUMMARY

In one embodiment, a component for a CMP tool is disclosed herein. The component includes a body having a surface that will be exposed to a polishing fluid when the CMP tool is polishing a substrate and a hydrophobic layer disposed on the surface of the body. The hydrophobic layer having a fluid contact angle of at least 90°.

In another embodiment, a component for a CMP tool is disclosed herein. The component includes a ring shaped body and a hydrophobic layer. The ring shaped body is defined by a lower side and an upper side. The lower side includes a lower edge, an upper edge, an outer surface having an outer diameter, an inner surface having an inner diameter, and a first hydrophobic layer. The upper edge extends towards the upper side. The inner diameter is less than the outer diameter. The outer surface and the inner surface are concentric about a central axis. The first hydrophobic layer is disposed on the inner surface of the lower side. The first hydrophobic layer has a contact angle of at least 90° when a fluid contacts a portion of the inner surface of the lower side. The upper side includes a lower edge, an upper edge, and outer surface having an outer diameter, an inner surface having an inner diameter, and a second hydrophobic layer. The lower edge is integral with the upper edge of the lower side. The upper edge of the upper side extends radially inward from the inner edge of the upper surface in an upwards direction. The outer diameter of the upper side is less than the outer diameter of the lower side. The inner diameter of the upper side is less than the inner diameter of the lower side. The second hydrophobic layer has a contact angle of at least 90° when a fluid contacts a portion of the inner surface of the upper side.

In yet another embodiment, a component in a CMP tool is disclosed herein. The component includes a disk shaped body and a hydrophobic layer deposited on the disk shaped body. The disk shaped body has a top surface, a bottom surface, an outer wall, an inner wall, and a ledge. The bottom surface is substantially parallel to the top surface. The outer wall is perpendicular to the bottom surface. The outer wall includes an outer diameter, a first end, and a second end. The first end of the outer wall is integral with the bottom surface. The second end is opposite the first end. The inner wall is perpendicular to the top surface. The inner wall includes an inner diameter, a first end, and a second end. The inner diameter is less than the outer diameter. The second end of the inner wall is integral with the top surface. The ledge is defined by the outer wall and the inner wall. The ledge is perpendicular to the outer wall and the inner wall. The ledge has a first end and a second end. The first end of the ledge is integral to the second end of the outer wall. The second end of the ledge is radially inward from the first end of the ledge. The second end of the ledge is integrally connected with the first end of the other wall. The second end of the outer wall is radially inward from the first end of the outer wall, towards the top surface. The hydrophobic layer has a contact angle of at least 90° when a fluid contacts a portion of disk shaped body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of the disclosure and are therefore not to be considered limiting of its scope, for the disclosure may admit to other equality effective.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present disclosure are described herein in accordance with components of a CMP tool.

Figure 1:
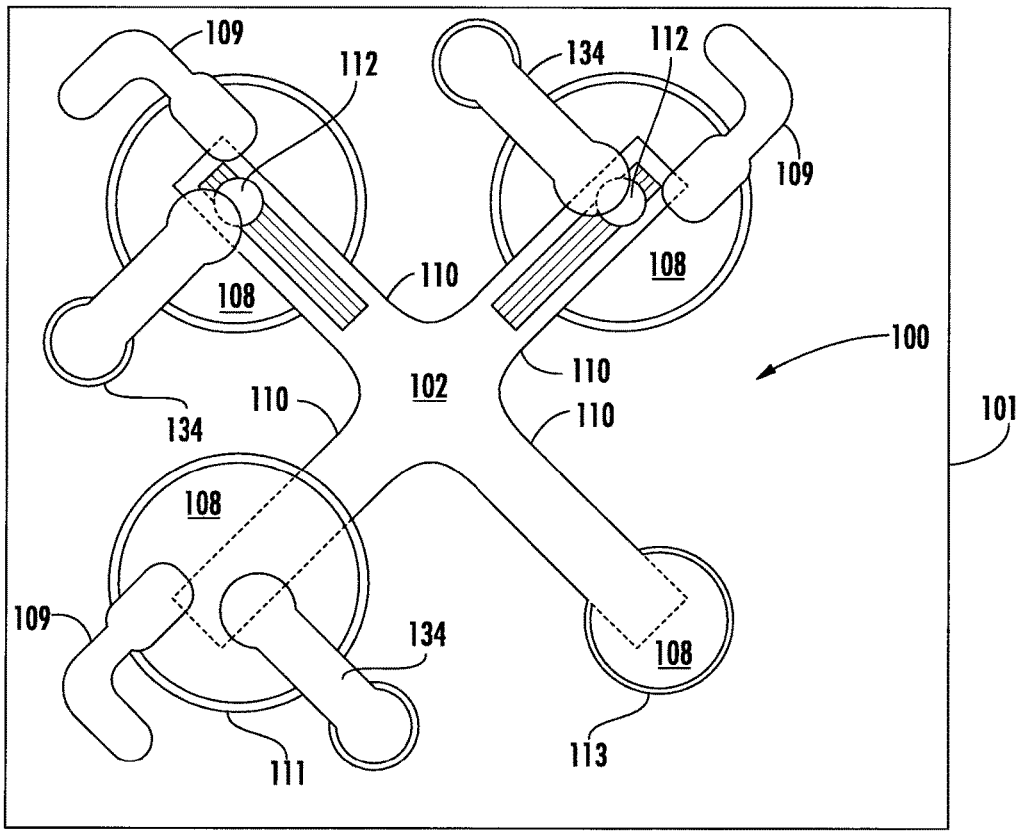
FIG. 1 illustrates a top view of a chemical mechanical polishing (CMP) tool for polishing a substrate, according to one embodiment.

FIG. 1 depicts a conventional chemical mechanical polishing (CMP) tool 100 for polishing a substrate (not shown). The CMP tool 100 may include a base 101. The base 101 includes a carriage 102 and a plurality of stations 108. The carriage 102 is centrally disposed on the base 101. The carriage 102 may include a plurality of arms 110, each supporting a polishing head 112. The arms 110 extend from the carriage 102 out over each station 108. The polishing heads 112 are generally supported above the stations 108. The polishing heads 112 include a recess (not shown) configured to retain a substrate during polishing. The stations 108 may be, for example, a transfer station 113 or a polishing station 111. Two arms 110 depicted in FIG. 1 are shown in phantom such that the transfer station 113 and polishing station 111 of the first station 108 may be shown. The carriage 102 is indexable such that the polishing head 112 may be moved between the polishing station 111 and the transfer station 113.

Conditioning devices 134 may be disposed on the base 101 adjacent to each of the polishing stations 111. The conditioning devices 134 may be used to periodically condition the polishing surface of the polishing stations 111 to maintain uniform polishing results.

Each polishing station 111 has a fluid delivery arm 109. The fluid delivery arm 109 delivers a polishing fluid to the polishing surface of the polishing station 111 so that a substrate may be polished. When the fluid is delivered to the polishing station 111, the polishing fluid may come into contact with components of the CMP tool. If a slurry is used as the polishing fluid, the slurry particles adhere to the different components of the CMP tool. Over time, the polishing slurry can rub over the surface of a component thereby dislodging component particles. Some of these particles may fall onto the polishing surface, and potentially become a source of scratches on the substrate being polished. These scratches may result in poor device performance and high defects. Additionally, the slurry particles may begin to erode those components of the CMP tool. Thus, there is a need to limit the contact between the fluid and the components of the CMP tool such that erosion of the components is delayed and the life span is extended.

Figure 2C:
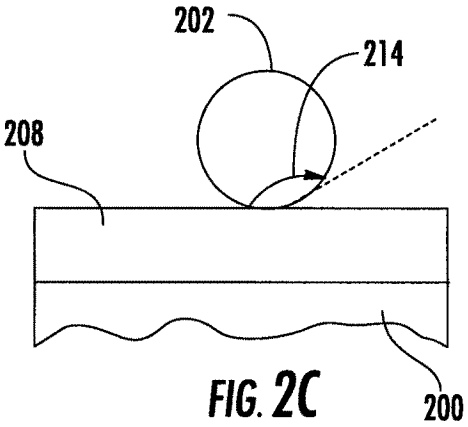
FIG. 2C illustrates a side view of a portion of a CMP tool component having a thicker hydrophobic layer than that deposited on the CMP tool component illustrated in FIG. 2B, according to one embodiment.
Figure 2B:
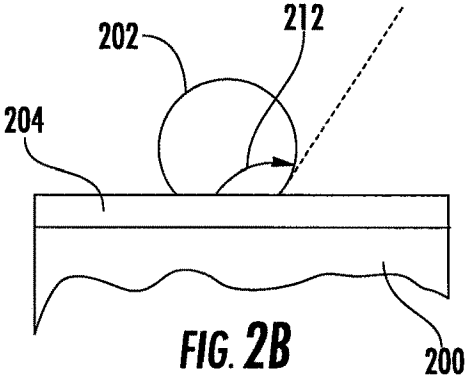
FIG. 2B illustrates a side view of a portion of a CMP tool component with a hydrophobic layer deposited thereon, according to one embodiment.
Figure 2A:
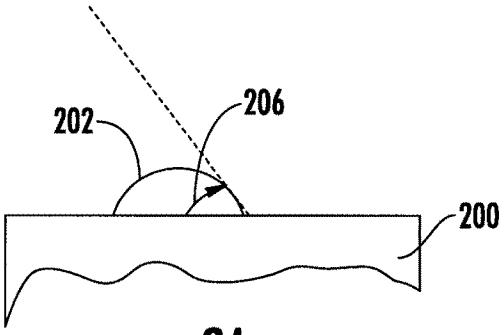
FIG. 2A illustrates a side view of a portion of a CMP tool component without a hydrophobic layer deposited thereon, according to one embodiment.

FIGS. 2A-2C compare CMP tool components with and without a hydrophobic layer applied to an exterior of the CMP tool component.

FIG. 2A illustrates a portion of a CMP tool component that does not have a hydrophobic layer on an exterior surface. The angle at which a fluid contacts the surface of the CMP tool component is referred to as the contact angle. The contact angle is determined by the resultant between adhesive and cohesive surfaces. When a fluid contacts the surface of the portion of the CMP tool component without a hydrophobic layer as illustrated in FIG. 2A, the contact angle 206 between the fluid and the CMP tool component is about 60°. A surface which has a high degree of wetting and a contact angle less than 90° is referred to as a hydrophilic surface. The measure of wetting of a surface is inversely related to the contact angle. The low contact angle between the fluid and the CMP tool components illustrates that the CMP tool has a high degree of wetting. A high degree of wetting results in more slurry particles adhering to an exterior surface of the CMP tool component. More slurry contact with CMP tool component increases the likelihood of dislodging some surface particles from the CMP tool component. Such dislodged component particles will fall onto the polishing surface of the polishing station and scratch the substrate.

The CMP tool components illustrated in FIGS. 2B-2C have a hydrophobic layer disposed an exterior surface of the component. The hydrophobic layer may be in the form of monomolecular layers (adsorbed orientated layers about one molecule thick) or lacquer films by treating a material with solutions, emulsions, or less frequently, vapors of hydrophobic agents, which are substances that interact weakly with water but attach themselves to a surface. The hydrophobic layer may be deposited on a CMP tool component using a plasma treatment performed in a plasma chamber. The plasma treatment utilizes a low-pressure plasma system, which is inexpensive and consumes minimal gas. In hydrophobic deposition process, monomers are introduced into the chamber and react chemically among each other to form polymers. These polymers then deposit as a hydrophobic layer onto the treated component. The monomers that are introduced into the chamber may be, for example, hexamethyldisiloxane, heptadecafluorodecyltrimethoxysilane, poly(tetrafluoroethylene), poly(propylene), octadecyldimethylchlorosilane, octadecyltrichlorosilane, tris(trimethylsiloxy)silylethyl-dimethylchlorosilane, octyldimethylchlorosilane, or dimethyldichlorosilane.

The contact angle between the fluid and the surface may be measured using different techniques. For example, one technique includes placing a sample, in this case a component of a CMP tool, on a flat surface. A constant volume of water or slurry solution is then dispersed onto the component with a pipette. While the droplets are on the hydrophobic layer disposed on the exterior of the component, a picture is taken of the droplet disposed on the layer. The angle between the droplet and the surface may be measured to determine the contact angle.

The contact angle of the hydrophobic layer may also be determined using a VCMA Optima analyser. The VCMA Optima analyser utilizes a precision camera and advanced PC technology to capture static or dynamic images of the droplet and determine tangent lines for the basis of contact angle measurement. A manual or automatic syringe may dispense the test liquid. Computerized measurement eliminates the human error element in measuring the contact angle. Dynamic images are able to be captured for time sensitive analysis.

Referring back to FIG. 2A, FIG. 2A depicts a droplet 202 of fluid on a conventional CMP tool component 200, which does not have a hydrophobic layer. The contact angle 206 of the droplet is about 60°. The low contact angle indicates a high degree of wetting of the surface of the component 200, which may contribute to erosion of the component 200 over time. Thus, the life span of the CMP tool component 200 is undesirably short.

FIG. 2B depicts a CMP tool component 200 having a hydrophobic layer 204 disposed on the top surface of the component 200. The hydrophobic layer 204 may be applied to the component 200 by plasma treatment or other suitable methods. A droplet 202 of fluid disposed on the hydrophobic layer 204 of the CMP tool component 200 has a contact angle 212. The hydrophobic layer 204 has a higher contact angle 212 than that of the surface of the conventional CMP tool 100 that does not have the hydrophobic layer. The contact angle 212 formed between the droplet 202 and the hydrophobic layer 204 on the component 200 is at least 90°. The higher contact angle 212, shown in FIG. 2B, indicates substantially less wetting for the surface. Thus, rather than wetting the CMP tool component 200, the droplet 202 easily rolls off the surface of the component 200. Therefore, erosion of the component 200 will be substantially less, thus increasing the life of the component 200. Additionally, if the polishing fluid is a slurry, the substantially less wetting results in less slurry particles adhering to the component 200. Less slurry particles adhering to the component 200 reduces the likelihood of the slurry particles dislodging surface particles of CMP tool components and eventually falling onto the polishing stations.

FIG. 2C depicts a CMP tool component 200 having a thicker hydrophobic layer 208 compared to the hydrophobic layer 204 illustrated in FIG. 2B. The thickness of the hydrophobic layer 208 may be controlled by the time the component 200 is exposed to the hydrophobic layer deposition process. The longer the CMP tool component 200 is exposed to the hydrophobic layer deposition process process, the thicker the hydrophobic layer 208. The thickness of the hydrophobic layer may range from 400 nm to 1600 nm. As the thickness of the hydrophobic layer 208 increases, the contact angle formed between the hydrophobic layer and the fluid increases. As the contact angle increases, the degree of wetting decreases. Thus, the thicker the hydrophobic layer, the lower the degree of wetting for the surface on which the hydrophobic layer is formed. The thicker hydrophobic layer 208 has the contact angle 214 between the droplet 202 and the component 200 of about 140°. This results in a low degree of wetting. Thus rather than wetting the CMP tool component 200, the droplet 202 easily rolls off the surface of the component 200. Therefore, erosion of the component 200 will be substantially less, thus increasing the life of the component 200. Additionally, if the polishing fluid is a slurry, the substantially less wetting results in less slurry particles adhering to the component 200. Less slurry particles adhering to the components 200 reduces the likelihood of the slurry particles falling onto the polishing stations.

Figure 3:
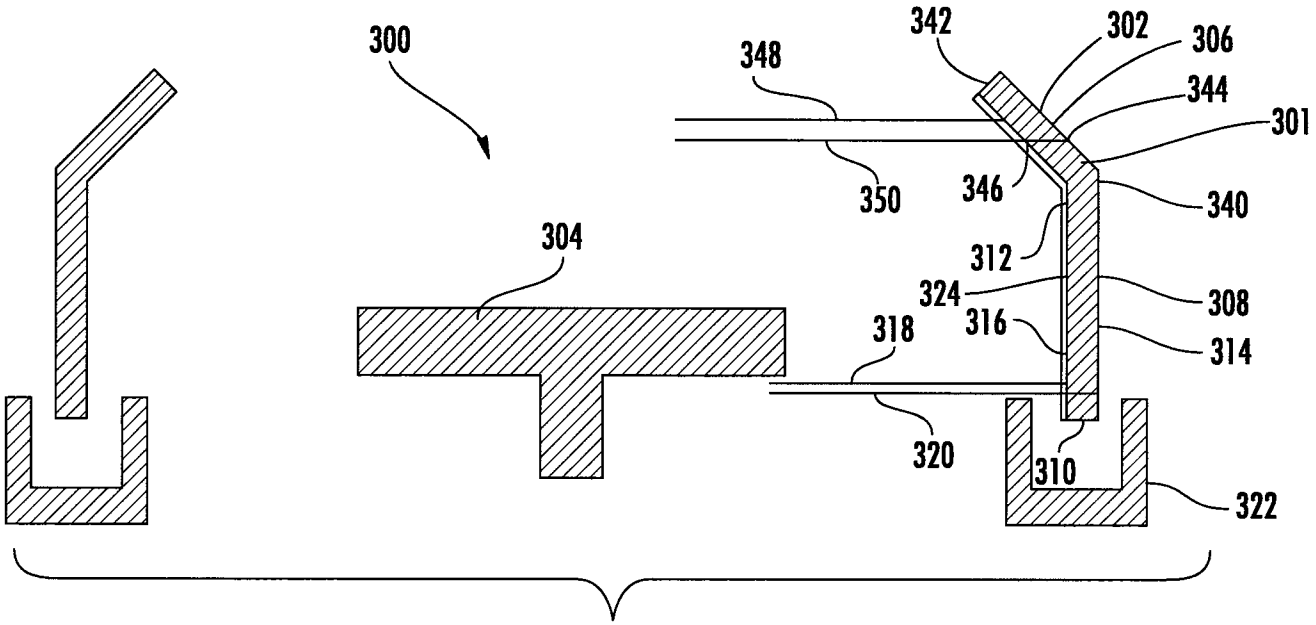
FIG. 3 illustrates a side view of a splash cover having a hydrophobic layer deposited thereon, according to one embodiment.

FIG. 3 depicts a cross-sectional view of a portion of a CMP tool component in the form of a splash cover 302 of a CMP tool 300. Only a polishing station 304 is illustrated in FIG. 3. The tool 300 is configured essentially the same as the tool 100 described in FIG. 1, except for one or more of the components of the tool 300 having a hydrophobic coating. The splash cover 302 circumscribes the polishing station 304. The splash cover 302 is used to block the polishing fluid from spinning off of the polishing station 304 and coating other areas of the CMP tool 300. The splash cover 302 includes a body 301 and a hydrophobic layer 324 disposed on the body 301. The body 301 has an upper side 306 and a lower side 308. The lower side 308 includes a lower edge 310, an upper edge 312, an outer surface 314, and an inner surface 316. The upper edge 312 is opposite the lower edge 310 and extends in an upward and inward direction towards the upper side 306. The outer surface 314 has an outer diameter 318. The inner surface 316 has an inner diameter 320. The inner diameter 320 is less than the outer diameter 318. The outer surface 314 and the inner surface 316 are concentric about a central axis.

The upper side 306 includes a lower edge 340, an upper edge 342, an outer surface 344, and an inner surface 346. The upper edge 342 extends radially inward from the lower edge 340 of the upper side 306 in an upwards direction. The lower edge 340 of the upper side 306 is integral with the upper edge 312 of the lower side 308 to form a continuous splash cover 302. The outer surface 344 has an outer diameter 348. The outer diameter 348 of the upper side 306 is less than the outer diameter 318 of the lower side 308. The inner surface 346 has an inner diameter 350. The inner diameter 350 of the upper side 306 is less than both the inner diameter 320 of the lower side 308 and the outer diameter 348 of the upper side 306.

Beneath the splash cover 302 may be a trough 322. The trough 322 collects the excess fluid or slurry that is directed downwards by the curvature of the splash cover 302.

The fluid that contacts the splash cover 302 may contain material removed from the substrate, material from the polishing surface, abrasive particles or chemical reagents, such as sodium hydroxide, or deionized water. The hydrophobic layer 324 deposited on the body 301 of the splash cover 302 prevents erosion and sticking particles. In one embodiment, the hydrophobic layer 324 may be placed on the inner surface 316 of the lower side 308 and the inner surface 346 of the upper side 306. The hydrophobic layer 324 extends the life of the splash cover 302 by delaying erosion. The presence of the hydrophobic layers 324 results in substantially less wetting of the carrier splash cover 302. Thus, rather than wetting the splash cover, the polishing fluid will easily roll off the surface the splash cover 302. Therefore, erosion of the splash cover 302 will be substantially less, thus increasing the life of the splash cover 302. Additionally, if the polishing fluid is a slurry, the substantially less wetting results in less slurry particles adhering to the splash cover 302. Less slurry particles adhering to the splash cover 302 reduces the likelihood of the slurry particles dislodging the particles from the surface of the splash cover and falling onto the polishing stations.

Figure 4:
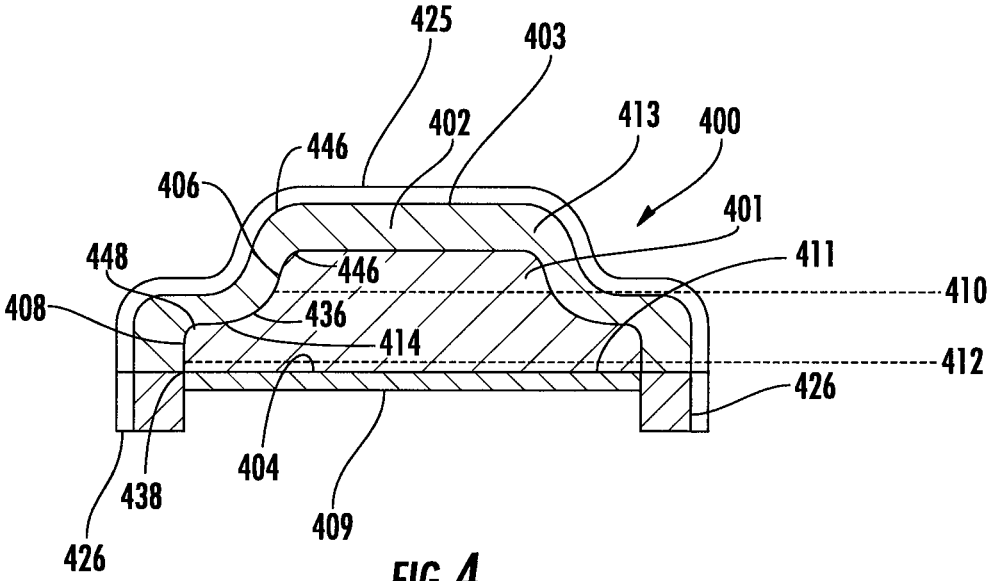
FIG. 4 illustrates a side view of a carrier cover having a hydrophobic layer deposited thereon, according to one embodiment.

FIG. 4 depicts a cross sectional view of one embodiment of a CMP tool component in the form of a carrier head assembly 400. The carrier head assembly 400 includes a carrier head 401, a retaining ring 426, a carrier cover 403, and a membrane 409. The carrier head 401 includes a body 411. The body 411 has an exposed upper surface 402, a bottom surface 404, an inner wall 406, and an outer wall 408. The upper surface 402 is substantially parallel to the bottom surface 404. The inner wall 406 further includes a first end 436, a second end 446, and an inner diameter 410. The outer wall 408 further includes a first end 438, a second end 448, and an outer diameter 412. The outer diameter 412 is larger than the inner diameter 410. A ledge 414 is formed in the carrier cover 403 by the inner diameter 410 and the outer diameter 412. The ledge 414 is substantially parallel to both the upper surface 402 and the bottom surface 404. The ledge 414 may be at a 90° angle with respect to the outer diameter 412. The membrane 409 is disposed beneath the bottom surface of the carrier head 401 and is circumscribed by the retaining ring 426. The membrane 409 provides a mounting surface for a substrate (not shown), when the carrier head 401 picks up a substrate to move the substrate among the stations (not shown).

The carrier cover 403 includes a body 413 and a hydrophobic layer 425 disposed on the body 413. The body 413 is configured to fit over the carrier head such that the exposed upper surface 402, ledge 414, walls 406, 408, are covered. The carrier cover 403 is exposed to the polish fluid during polishing. The polishing fluid that is delivered to the polishing station may contact the carrier cover 403 and/or the carrier head 401. The polishing fluid may be a slurry that contains abrasive particles or chemical reagents, such as sodium hydroxide, or may be deionized water. The hydrophobic layer 425 extends the life of these components by delaying erosion. The presence of the hydrophobic layer 425 results in substantially less wetting of the carrier head 401 and carrier cover 403. Thus, rather than wetting the carrier head 401 and carrier cover 403, the polishing fluid will easily roll off the surface the carrier head 401 and carrier cover 403. Therefore, erosion of the carrier head 401 and the carrier cover 403 will be substantially less, thus increasing the lives of the carrier head 401 and the carrier cover 403. Additionally, if the polishing fluid is a slurry, the substantially less wetting results in less slurry particles adhering to the carrier head 401 and the carrier cover 403. Less slurry particles adhering to the carrier head 401 and the carrier cover 403 reduces the likelihood of the slurry particles dislodging the particles from the surface of the component and falling onto the polishing stations.

Figure 5:
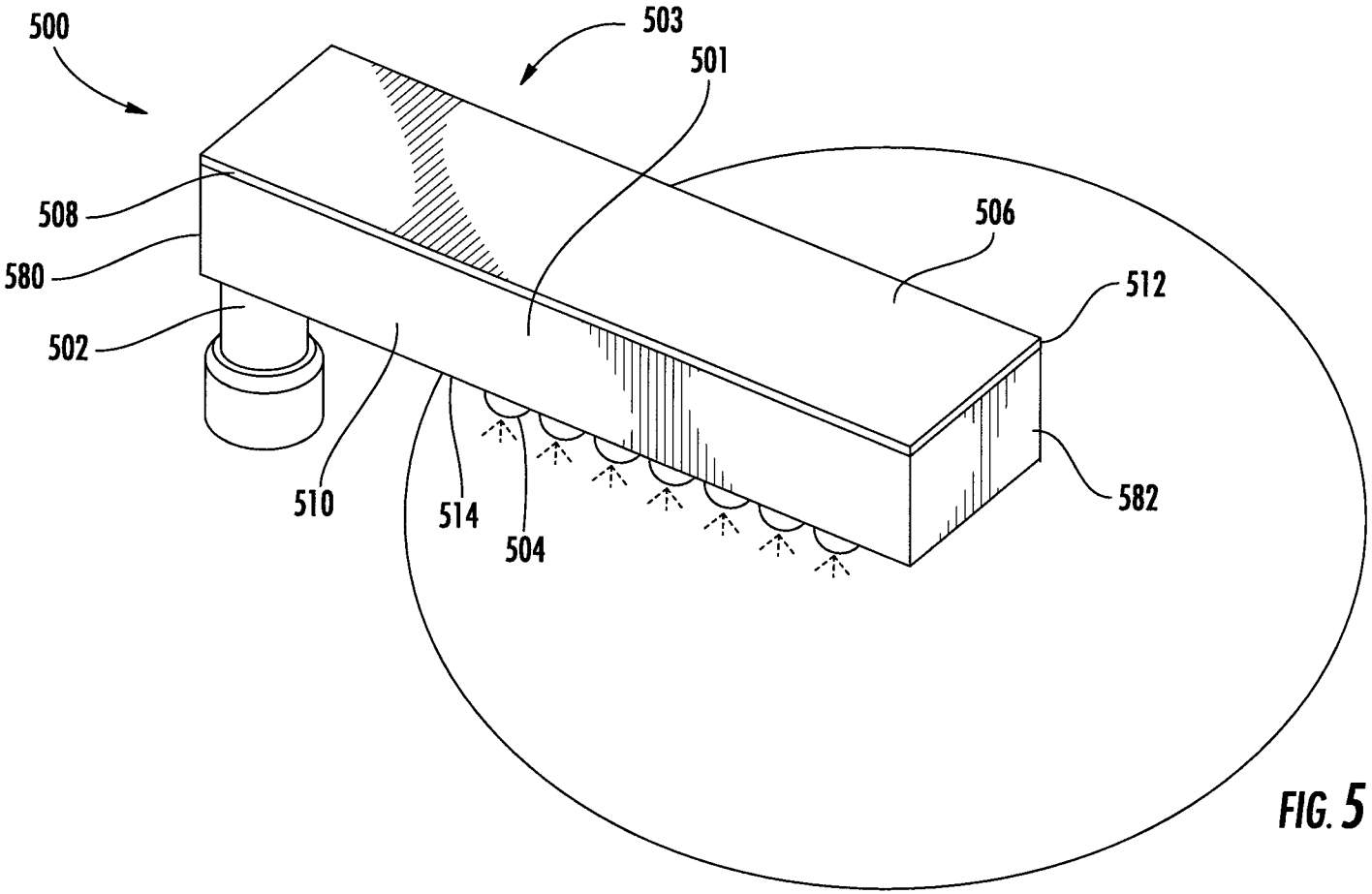
FIG. 5 illustrates a side view of a polishing fluid delivery arm having a hydrophobic layer deposited thereon, according to one embodiment.

FIG. 5 shows a side view of a CMP tool component in the form of a polishing fluid delivery arm assembly 500. The polishing fluid delivery arm assembly 500 includes a fluid delivery arm 503, a base member 502, nozzles 504, and fluid delivery hoses (not shown). The fluid delivery arm 503 includes a body 501 and a hydrophobic layer 508 disposed on the body 501. The body 501 includes a top elongated surface 506, a first lateral side 510, a second lateral side 512 opposite the first lateral side 510, a bottom 514, a first end 580, and a second end 582. The first end 580 is coupled to the base member 502. The elongated surface 506 runs from the first end 580 to the second end 582. The second end 582 hangs out and over the polishing station (not shown). The nozzles 504 are located on the bottom 514 of the body 501. The nozzles 504 provide a polishing fluid to the surface of a substrate (not shown). Fluid delivery hoses bring the polishing fluid to the nozzles 504 for dispersion on to the polishing surface on which the substrate is polished.

The entire body 501 may be covered with the hydrophobic layer 508. Alternatively, at least one of the first lateral side 510, the opposing second lateral side 512, top elongated surface 506, or the bottom 514 may be covered with the hydrophobic layer 508. Polishing fluid may contact the fluid delivery arm 503 when the nozzles 504 provide a polishing fluid to the polishing surface of the polishing station 111 when polishing a substrate. The presence of the hydrophobic layer 508 results in substantially less wetting of the fluid delivery arm 503. Thus, rather than wetting the CMP tool fluid delivery arm 503 the polishing fluid will easily roll off the surface of the fluid delivery arm 503. Therefore, erosion of the fluid delivery arm 503 will be substantially less, thus increasing the life of the fluid delivery arm 503. Additionally, if the polishing fluid is a slurry, the substantially less wetting results in less slurry particles adhering to the fluid delivery arm 503. Less slurry particles adhering to the fluid delivery arm 503 reduces the likelihood of the slurry particles dislodging the particles from the surface of the component and falling onto the polishing stations and scratching the substrate. Thus, there is a higher device quality and yield.

Figure 6:
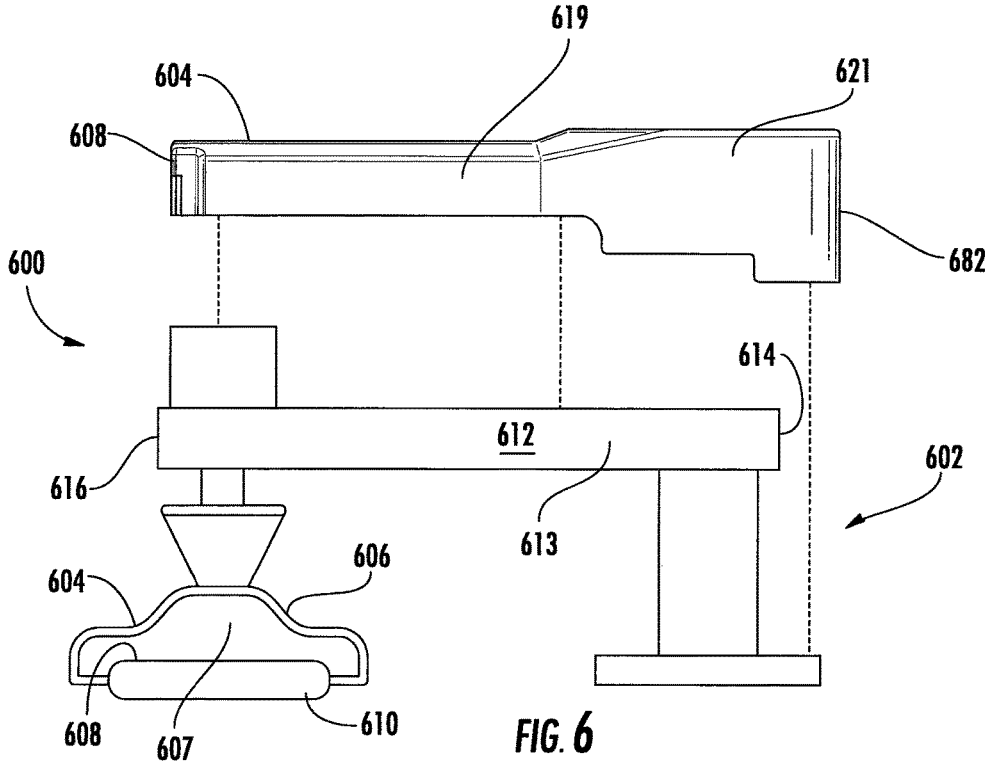
FIG. 6 illustrates a side view of one embodiment of a portion of a polishing apparatus having a hydrophobic layer deposited thereon, according to one embodiment.

FIG. 6 depicts one embodiment of a portion of a polishing apparatus assembly 600 for polishing a substrate 610. The portion of a polishing apparatus assembly 600 includes a carriage 602, a plurality of arms 612, an arm cover 621, and a polishing head 606. Each arm 612 has a body 613. The body 613 includes a first end 614 and a second end 616. The first end 614 of the body 613 is coupled to the carriage 602. The second end 616 of the body 613 extends from the carriage 602, over a polishing station (not shown). The second end 616 of the body 613 is coupled to the polishing head 606.

The polishing head 606 includes a body 607 and a hydrophobic layer 604 disposed on the body 607. A recess 608 is formed in the body 607. The polishing head 606 retains the substrate 610 in the recess 608 that faces the polishing station. The polishing head 606 may press the substrate 610 against a polishing material (not shown) during processing. The polishing head 606 may be stationary or rotate, isolate, move orbitally, linearly or a combination of motions while pressing the substrate 610 against the polishing material.

The arm cover 621 may be placed over an arm 612 from the first end 614 to the second end 616. The arm cover 621 may further protect the arm 612 from fluid. The arm cover 621 includes a body 619 having a hydrophobic layer 604 disposed thereon. The body 619 has a first end 680 and a second end 682. The body 619 has a width slightly wider than the width of the arm 612 and a length slightly longer than the length of the arm 612, such that the arm cover 621 may be fitted over the arm 612. The presence of the hydrophobic layer 604 on the polishing head 606 and the arm cover 621 results in substantially less wetting of the arm cover 621 and the polishing head 606. Thus, rather than wetting the CMP tool polishing head 606 and the arm cover 621, the polishing fluid will easily roll off the polishing head 606 and the arm cover 621 of the polishing head 606 and the arm cover 621. Therefore, erosion of the polishing head 606 and the arm cover 621 will be substantially less, thus increasing the life of the polishing head 606 and the arm cover 621. Additionally, if the polishing fluid is a slurry, the substantially less wetting results in less slurry particles adhering to the polishing head 606 and the arm cover 621. Less slurry particles adhering to the polishing head 606 and the arm cover 621 reduces the likelihood of the slurry particles dislodging the particles from the surface of the component and falling onto the polishing stations and scratching the substrate. Thus, the hydrophobic layer results in a higher device quality and yield.

Figure 7:
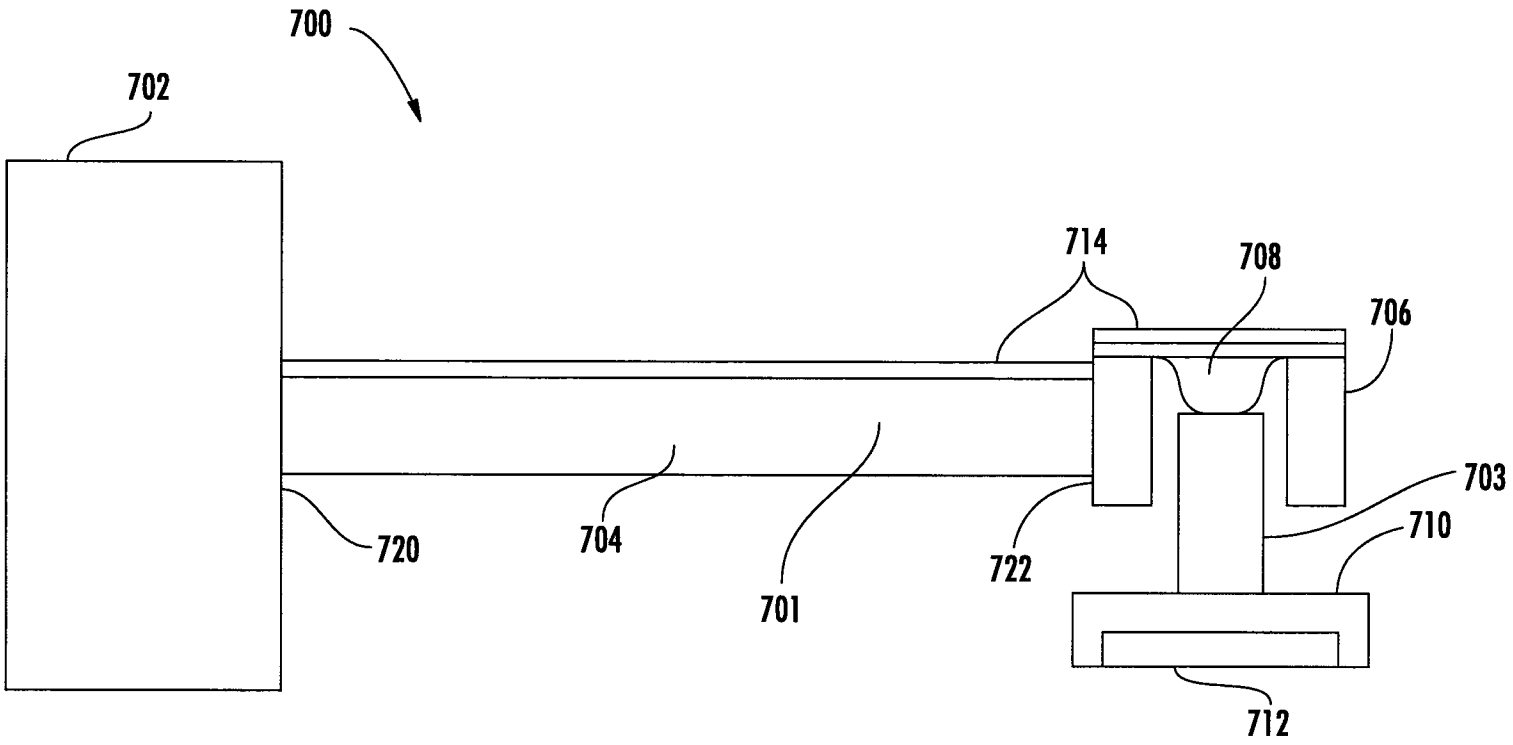
FIG. 7 illustrates a side view of a pad conditioning arm of a CMP tool having a hydrophobic layer deposited thereon, according to one embodiment.

FIG. 7 is a side view of a CMP tool component in the form of a pad conditioning arm assembly 700. The pad conditioning arm assembly 700 includes a body 701 having a base 702, a pad conditioning arm 704, and a conditioner head 706. The pad conditioning arm 704 has a first end 720, coupled with the base 702, and a second end 722, coupled to the conditioner head 706. The conditioner head 706 further includes a body 703. The body 703 has a hydrophobic layer 714 disposed thereon. The body 703 may be coupled to a rotable and vertically movable end effector 710 that holds a conditioning disk 712. The conditioning disk 712 has a bottom surface embedded with diamond abrasives, which can be rubbed against the surface of the polishing pad to retexture the pad. The conditioning disk 712 can be held in the end effector 710 by magnets (not shown), or mechanical fasteners (not shown). A gimbal mechanism (not shown) may be coupled between the end effector 710 and the conditioner head 706, the gimbal mechanism allowing the end effector 710 to tilt at an angle relative to the pad conditioning arm 704.

Vertical motion of the end effector 710 and control of the pressure of the conditioning disk 712 can be provided by a vertical actuator (not shown) in the conditioner head 706, such as a pressurizable chamber 708 positioned to apply a downward pressure to the end effector 710.

During the polishing process, the components of the pad conditioning arm assembly 700 are susceptible to contact with the fluid or slurry used. Over time, continuous contact with the fluid or slurry may result in erosion of these components. The presence of the hydrophobic layer 714 results in substantially less wetting of the arms 704 and the pad conditioner head 706. Thus, rather than wetting the polishing pad conditioning arm 704 and the conditioner head 706, the polishing fluid will easily roll off the surfaces of the polishing pad conditioning arm 704 and the conditioner head 706. Therefore, erosion of the polishing pad conditioning arm 704 and the conditioner head 706 will be substantially less, thus increasing the lives of the polishing pad conditioning arm 704 and the conditioner head 706. Additionally, if the polishing fluid is a slurry, the substantially less wetting results in less slurry particles adhering to the polishing pad conditioning arm 704 and the conditioner head 706. Less slurry particles adhering to the polishing pad conditioning arm 704 and the conditioner head 706 reduces the likelihood of the slurry particles dislodging the particles from the surface of the component and falling onto the polishing stations and scratching the substrate. Thus, there is a higher device quality and yield.

By depositing a hydrophobic layer on components of a CMP tool, erosion of the components is delayed and the life spans of these components are increased.

While the foregoing is directed to embodiments of the present disclosure, other and further embodiments of the disclosure may be devised without departing from the basic scope thereof, and the scope thereof is determined by the claims that follow.

What is claimed is:

1. A component for a CMP tool, the component comprising:

a body having a surface that will be exposed to a polishing fluid when the CMP tool is polishing a substrate; and a hydrophobic layer disposed on the surface of the body, the hydrophobic layer having a thickness between 400 nm and 1600 nm and a fluid contact angle from 90° to about 140°, the hydrophobic layer is formed from a monomer, wherein the monomer is selected from the group consisting of octadecyldimethylchlorosilane, tris (trimethylsiloxy)silylethyl-dimethylchlorosilane, and octyldimethylchlorosilane.

2. The component of claim 1, wherein the component is a component for delivering a fluid in a CMP tool, the component for delivering a fluid in a CMP tool comprising:

an elongated member, wherein the elongated member further comprises:

a first end;

a second end; and an elongated upper surface extending between the first end and the second end, wherein the hydrophobic layer is disposed on the elongated upper surface of the elongated member.

3. The component of claim 2, wherein the elongated member is a fluid delivery arm.

4. The component of claim 2, wherein the elongated member is a pad conditioning arm.

5. The component of claim 2, wherein the elongated member is an arm cover.

6. A component for delivering a fluid in a CMP tool comprising:

an elongated member, wherein the elongated member comprises:

a first end;

a second end;

an elongated upper surface extending between the first end and the second end; and a hydrophobic layer disposed on the elongated upper surface, the hydrophobic layer having a fluid contact angle from 90° to about 140°, the hydrophobic layer is formed from a monomer, wherein the monomer is selected from the group consisting of octadecyldimethylchlorosilane, tris(trimethylsiloxy)silylethyl-dimethylchlorosilane, and octyldimethylchlorosilane.

7. The component of claim 6, wherein the elongated member is a fluid delivery arm.

8. The component of claim 6, wherein the elongated member is a pad conditioning arm.

9. The component of claim 6, wherein the elongated member is an arm cover.

10. A component for delivering a fluid in a CMP tool comprising:

a body having a first surface that will be exposed to a polishing fluid when the CMP tool is polishing a substrate, wherein the body is an elongated member comprising:

a first end;

a second end; and an elongated upper surface extending between the first end and the second end; and a hydrophobic layer disposed on the first surface of the body, the hydrophobic layer having a fluid contact angle of from 90° to about 140°, the hydrophobic layer is formed from a monomer, wherein the monomer is selected from the group consisting of octadecyldimethylchlorosilane, tris(trimethylsiloxy)silylethyl-dimethylchlorosilane and octyldimethylchlorosilane.

11. The component of claim 10, wherein the elongated member is a fluid delivery arm.

12. The component of claim 10, wherein the elongated member is a pad conditioning arm.

13. The component of claim 10, wherein the elongated member is an arm cover.

* * * * *